United States Patent [19]

Osumi et al.

[11] Patent Number: 4,587,693

[45] Date of Patent: May 13, 1986

[54] BUTTON

[75] Inventors: Kinzo Osumi; Toshio Ozawa, both of Ohta, Japan

[73] Assignee: Osumi Metal Industry Co., Ltd., Oaza-Higashiyajima, Japan

[21] Appl. No.: 775,775

[22] Filed: Sep. 13, 1985

[30] Foreign Application Priority Data

Oct. 3, 1984 [JP] Japan ..... 59-149650[U]

[51] Int. Cl.[4] ..... A44B 1/18

[52] U.S. Cl. ..... 24/111; 24/90 R; 24/90 B

[58] Field of Search ..... 24/111, 90 R, 90 B, 24/90 A, 102 R

[56] References Cited

U.S. PATENT DOCUMENTS

| | | | |
|---|---|---|---|
| 310,939 | 1/1885 | Goddard | 24/111 |
| 363,676 | 5/1887 | Platt | 24/111 |
| 380,678 | 4/1888 | Ellis | 24/111 |
| 495,754 | 4/1893 | Platt | 24/111 |
| 2,077,691 | 4/1937 | Hawn | 24/90 B |
| 3,439,439 | 4/1969 | Stimson | 24/90 A |

FOREIGN PATENT DOCUMENTS

| | | | |
|---|---|---|---|
| 11046 | 5/1916 | United Kingdom | 24/111 |
| 1433329 | 4/1976 | United Kingdom | 24/90 B |

*Primary Examiner*—Victor N. Sakran

[57] ABSTRACT

A button of the type including a body of which bottom portion is formed with a recess or stepped part at the central area thereof, a fastening leg member made of resilient material, the fastening leg member having an opposing pair of end parts bent outwardly, and a holder with a slot formed therein through which the fastening leg member is inserted by manual force, wherein fitting of the fastening leg member to the body is achieved by way of the steps of fitting the holder onto the fastening leg member at the position as determined between the central part and the pair of end parts of the fastening leg member, inserting the pair of end parts of the fastening leg member through a slot on the bottom portion of the body, turning the fastening leg member within the slot and then causing the pair of end parts to be expanded in a pair of cutouts under the effect of expansive resilient force of the fastening leg member.

2 Claims, 9 Drawing Figures

BUTTON

BACKGROUND OF THE INVENTION (1) Field of the Invention

The present invention relates to a button of the type including a body of which outer surface is designed in the required decorative fashion and a fastening leg member adapted to be fastened to clothes such as dress or the like, wherein the body is detachably fitted onto the fastening leg member.

(2) Description of the Prior Art

As is well known, a button is usually fastened to clothes by using thread which is needled through the latter and therefore disconnection of the button can be achieved only by cutting off thread. On the other hand, a hitherto known detachable button is generally fastened to clothes without the use of thread in such a manner that fabric is punched to form a hole through which a fastening member is inserted and both a button body and the fastening member are then integrally assembled by means of screw or the like. However, it has been found that the conventional detachable type button has drawbacks that dislocation of the fastened position is difficult once both the body and the fastening member are assembled in that way, since fastening is achieved with the fabric clamped between the body on the outer side and the screw on the rear side relative to the fabric, and moreover threadable assembling and disassembling are carried out only with considerable difficult.

SUMMARY OF THE INVENTION

Hence, the present invention has been made with the foregoing background in mind and its object resides in providing a button which can be fastened to clothes by using thread in the same manner as in the case of conventional buttons and of which body can be easily connected to and disconnected from a fastening leg member.

To accomplish the above object there is proposed according to the present invention a button of the type including a body of which bottom portion is formed with a recess or stepped part at the central area thereof, a fastening leg member made of resilient material, the fastening leg member having an opposing pair of end parts bent outwardly, and a holder with a slot formed therein through which the fastening leg member is inserted by manual force, wherein fitting of the fastening leg member to the body is achieved by way of the steps of fitting the holder onto the fastening leg member at the position as determined between the central part and the pair of end parts of the fastening leg member, inserting the pair of end parts of the fastening leg member through a slot on the bottom portion of the body, turning the fastening leg member within the slot and then causing the pair of end parts to be expanded in a pair of cutouts under the effect of expansive resilient force of the fastening leg member.

According to the present invention the body of the button can be easily connected to and disconnected from the fastening leg member irrespective of whether the button is fastened to clothes or not. Further, in case where the decorative portion of the button body has a directional decorative pattern, the direction of fastening of the button can be easily corrected even after completion of fastening operation by determining the direction of extension of the slot on the bottom portion in accordance with the direction of formation of the decorative pattern.

Other objects, features and advantages of the invention will become more clearly apparent from reading of the following description which has been prepared in conjunction with the accompanying drawings.

BRIEF DESCRIPTION OF THE DRAWINGS

The accompanying drawings will be briefly described below.

DESCRIPTION OF THE PREFERRED EMBODIMENT

Now, the present invention will be described in a greater detail hereunder with reference to the accompanying drawings which illustrate a button in accordance with an embodiment of the invention.

Figure 1:
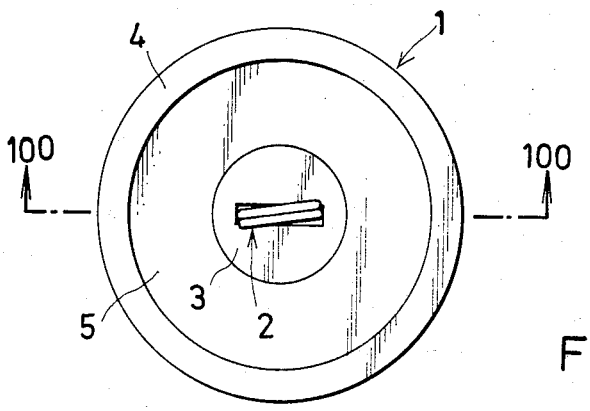
FIG. 1 is a bottom view of a button in accordance with an embodiment of the invention.
Figure 2:
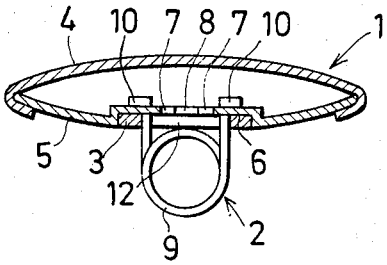
FIG. 2 is a sectional view of the button taken in line A—A in FIG. 1.

FIGS. 1 and 2 illustrate a button of the invention in the assembled state.

As will be readily apparent from the drawings, the button of the invention is constituted by a combination of button body 1, fastening leg member 2 and holder 3.

Figure 3:
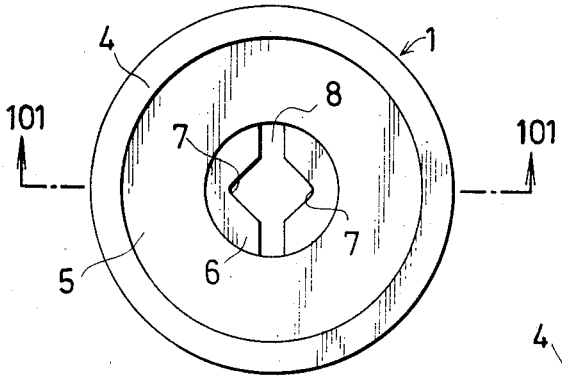
FIG. 3 is a bottom view of a button body constituting the button of the invention.
Figure 4:
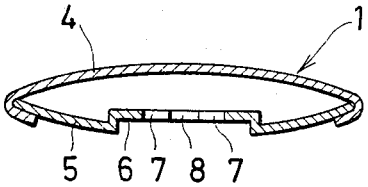
FIG. 4 is a sectional view of the button body taken in line B—B in FIG. 3.

As illustrated in FIGS. 3 and 4, the body 1 comprises a decorative portion 4 extending over the whole surface of the button and a base portion 5 disposed on the rear side of the same.

The base portion 5 is formed with a circular recess 6 at the central area thereof.

As will be best seen from FIG. 3, the recess 6 on the base portion 5 has a slot 8 and an opposing pair of cutouts 7 are provided on both the side edges of the slot 8.

Each of the cutouts 7 is designed in the substantially isosceles trainagle-shaped configuration.

Figure 5:
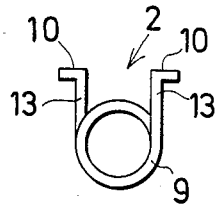
FIG. 5 is a front view of a fastening leg member which is other component constituting the button of the invention.
Figure 6:
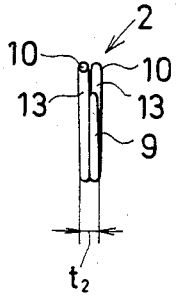
FIG. 6 is a side view of the fastening leg member in FIG. 5.

The fastening leg member 2 is made of resilient material. As illustrated in FIGS. 5 and 6, it is designed in the form of a substantially U-shaped spring of which central part 9 is circularly bent by one and half turns and of which both end parts 10 are projected outwardly.

Figure 7:
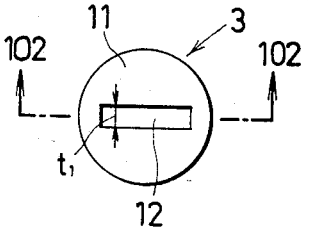
FIG. 7 is a plan view of a holder which is another component constituting the button of the invention.
Figure 8:
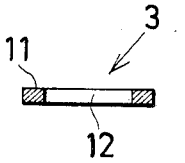
FIG. 8 is a sectional view of the holder taken in line C—C in FIG. 7.

As is apparent from FIGS. 7 and 8, the holder 3 comprises a circular plate 11 with a slot 12 formed at the central part thereof.

It should be noted that the width $t_1$ of the slot 12 is determined appreciably less than the width $t_2$ of the fastening leg member 2 (see FIG. 6).

Next, description will be made below as to how the fastening leg member 2 and the holder 3 are attached to the button body 1 and moreover description will be made as to function of the button of the invention.

First, the fastening leg member 2 is fitted through the slot 12 of the holder 3 from the bottom side as seen in the drawings while its end parts 10 are compressed against resilient force of the U-shaped spring.

It should be noted that the holder 3 is immovably held at the position located in the vicinity of both the end parts 10 of the fastening leg member 2 in such a manner that the end parts 10 are spaced away from the holder 3 by a very short distance.

At this moment the holder 3 is held in the temporaryly fixed state relative to the fastening leg member 2 under the effect of resilient force of the fastening leg member 2.

Next, the fastening leg member 2 with the holder 3 temporaryly fixed thereto is fitted through the slot 8 of the base portion 5 of the button body 1 from the bottom side as seen in the drawings.

Figure 9:
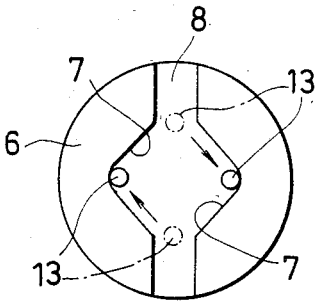
FIG. 9 is a fragmental bottom view of the button body, particularly illustrating how the fastening leg member is engaged to the button body under the effect of expansive resilient force.

At this moment both the foot portions 13 of the fastening leg member 2 (see FIGS. 5 and 6) assume the position as identified by phantom lines in FIG. 9 and the holder 3 is fitted into the recess 6 of the base portion 5 of the button body 1.

After completion of fitting operation the fastening leg member 2 is turned in the clockwise direction as represented by arrow marks in FIG. 9 or in the anticlockwise direction whereby the foot portions 13 of the fastening leg member 2 are brought into the cutouts 7 of the slot 8 while the base portion 5 is clamped between the end parts 10 of the fastening leg member 2 and the holder 3.

At this moment the foot portions 13 of the fastening leg member 2 assumed the position as represented by real lines in FIG. 3 while they are expanded in the cutouts 7 under the effect of expansive resilient force of the foot portions 13.

Thus, fitting of the fastening leg member 2 and the holder 3 to the button body 1 is completed.

The state as to how the fastening leg member and the holder are fitted to the body of the button will be readily apparent from FIGS. 1 and 2.

As will be readily understood from the above description, the holder 3 has two functions, one of them being to determine the position where the end parts 10 of the fastening leg member 2 are fitted through the slot 8 on the button body 1 and the other one being to inhibit the fastening leg member 2 from being displaced in the lateral direction while the fastening leg member 2 is kept in the fitted state.

Obviously, the button which has been assembled in the above-described manner is not a so-called solid button, because the button body 1 and the fastening leg member 2 are parted away from one another when the end parts 10 of the fastening leg member 2 are displaced out of the base portion 5 through the slot 8 after they are forcibly turned from the cutouts 7 against expansive resilient force of the foot portions 13 of the fastening leg member 2. Separation of the button body 1 from the fastening leg member 2 can be easily achieved by manual operation.

By virtue of arrangement of the button of the invention made in that way the button body can be easily disconnected from the fastening leg member on a dress or the like clothes by way of the steps as described above.

Accordingly, the button of the invention has the advantageous features that washing can be achieved without any damage caused on the button and fabric on which the latter is fastened and one button can be exchanged with another button having a decorative surface different from that of the former by manual operation of button user.

In the foregoing embodiment the body 1 of the button is constituted by a combination of decorative portion 4 and base portion 5 both of which are separate components. However, the present invention should not be limited only to this. Alternatively, the body of the button may be constituted by a combination of decorative portion and base portion which is made integral with the former.

Further, in the foregoing embodiment the fastening leg member is designed in such a manner that the central part 9 has the ring-shaped configuration. However, this present invention should not be limited only to this. The fastening leg member may be designed in the simple U-shaped configuration.

Further, in the foregoing embodiment the slot 12 on the holder 3 has the rectangular configuration. However, the present invention should not be limited only to this. Alternatively, the slot on the holder may have other configuration of which both end parts are shaped to a circular or polygonal contour respectively in order to assure that both the foot portions 13 of the fastening leg member 2 are immovably held at the predetermined position.

As will be readily understood from the above description, the botton of the invention has many advantageous features. For instance, the body of the button can be easily engaged to and disengaged from the fastening leg member irrespective of whether the button is fastened to clothes or not. In case where the decorative portion of the button body has a directional decorative pattern, the direction of fastening of the button can be easily corrected even after completion of fastening operation by determining the direction of extension of the slot on the bottom portion in accordance with the direction of formation of the decorative pattern.

What is claimed is:

1. A button of the type including a body of which bottom portion is formed with a recess or stepped part at the central area thereof, a fastening leg member made of resilient material, said fastening leg member having an opposing pair of end parts bent outwardly, and a holder with a slot formed therein through which the fastening leg member is inserted by manual force, wherein fitting of the fastening leg member to the body is achieved by way of the steps of fitting the holder onto the fastening leg member at the position as determined between the central part and the pair of end parts of the fastening leg member, inserting the pair of end parts of the fastening leg member through a slot on the bottom portion of the body, turning the fastening leg member within said slot and then causing the pair of end parts to be expanded in a pair of cutouts under the effect of expansive resilient force of the fastening leg member.

2. A button as defined in claim 1, wherein the fastening leg member is designed in the substantially U-shaped configuration.

* * * * *